US005896633A

United States Patent [19]

Fehrer

[11] Patent Number: 5,896,633

[45] Date of Patent: Apr. 27, 1999

[54] METHOD AND DEVICE FOR NEEDLING A WEB

[76] Inventor: Ernst Fehrer, Auf der Gugl 28, A-4020 Linz, Austria

[21] Appl. No.: 08/992,044

[22] Filed: Dec. 17, 1997

[30] Foreign Application Priority Data

Dec. 23, 1996 [AT] Austria ..... 2248/96
Apr. 29, 1997 [AT] Austria ..... 742/97

[51] Int. Cl.[6] ..... D04H 18/00

[52] U.S. Cl. ..... 28/107; 28/103

[58] Field of Search ..... 28/103, 107, 108, 28/109, 110, 111, 112, 113, 114, 115; 242/412.2, 413.9, 615.4

[56] References Cited

U.S. PATENT DOCUMENTS 3,488,250 1/1970 Zocher ..... 28/107
3,681,822 8/1972 Sanders ..... 28/107
3,719,546 3/1973 Parlin ..... 28/113
3,994,759 11/1976 Stoller ..... 28/107
5,508,775 4/1996 Mizuno ..... 242/412.3

*Primary Examiner*—John J. Calvert
*Assistant Examiner*—Larry D. Worrell, Jr.
*Attorney, Agent, or Firm*—Collard & Roe, P.C.

[57] ABSTRACT

A method of needling a web comprises the steps of continuously supplying the web to needles, reciprocating the needles to stitch the web supplied to the needles and to release the stitched web, moving the released stitched web step by step by subjecting the released stitched web to a weight load, and then continuously withdrawing the released stitched web. An apparatus for carrying out this method comprises a dancing roller arranged to exert the weight load between a stitch base and means for continuously withdrawing the stitched web.

6 Claims, 3 Drawing Sheets

METHOD AND DEVICE FOR NEEDLING A WEB

BACKGROUND OF THE INVENTION

1. Field of the Invention

This invention relates to a method for needling a web by means of needles repeatedly stitching into the web, where the web continuously supplied to the needles is moved on with respect to the needles step by step during the release by the needles between the needle impingements and is then withdrawn, and to a device for carrying out the method.

2. Description of the Prior Art

In known needling machines the feed of the web, which during the needling process is guided between a stitch base and a stripper, is effected by a continuously driven discharge roller. Despite this continuously driven discharge roller a stepwise conveyance of the web with respect to the needle area is obtained, because the web is retained with respect to the discharge roller by the impinging needles and is moved on only during its release by the needles between the succeeding needle impingements. The continuously driven discharge roller therefore necessarily involves a stretching of the web, where the withdrawal speed depends on the admissible degree of stretching of the web, on the stitching frequency of the needles and on the needle stroke, and thus on the period of the release of the web by the needles. Apart from the fact that these parameters limit the withdrawal speed, the needling result is impaired considerably by the tensile stress of the web increasing with the withdrawal speed during the needle impingement. In this connection it should also be considered that with increasing distribution density of the needles the tensile stress of the web is increased, because with increasing number of needles stitching into the web the bending elasticity of the individual needles can less and less be utilized for a resilient retainment of the web with respect to the discharge roller.

SUMMARY OF THE INVENTION

It is therefore the object underlying the invention to provide a method of needling a web as described above, by means of which a particularly good needling can easily be realized without having to fear an undesired tensile stress or stretching of the web.

This object is solved by the invention in that the web is moved out of the needle area by a weight load disposed before the discharge roller.

The weight load of the web disposed before the discharge roller is advantageously achieved in that during the release by the needles the web is moved on in the vicinity of the needle board so as to lead with respect to the discharge roller, so that during the subsequent needle impingement and the related retainment of the web there is first of all withdrawn the sag formed by the weight-related lead between the needle board and the discharge roller. Thus, it is merely by the predeterminable weight load that a tensile stress is applied onto the web in the needle area not only during its release by the needles, but also during the needle impingement, as long as the sag formed between the needle impingements is withdrawn against the weight load. Since the web is continuously supplied to the needle area, the stored length piled up before the needle area during the needle impingement is withdrawn by means of the weight load of the web disposed subsequent to the needle area, when the web is released by the needles. By means of the feed rate of the web the length of the conveying steps between the individual needle impingements can thus be adjusted on the condition that the stored length piled up during the needle impingement can be withdrawn completely by means of the weight load at best supported by the stream of conveying air. Since the tensile stress of the web can largely be adjusted by means of the weight load, the elastic bending behavior of the needles plays no decisive role for the stepwise conveyance of the web, so that it is also possible to perform needlings with a comparatively large distribution density of the needles without an increased tensile stress of the web.

For the execution of this method there may be used a device comprising at least one needle board reciprocatingly movable in stitching direction, comprising a stitch base opposite the needle board and comprising a continuously movable discharge roller, when between the stitch base and the discharge roller a dancing roller is provided as weight load for the web. This dancing roller provides in a constructively simple way a uniform weight load over the width of the web, which leads to a stock loop forming during the release of the web by the needles in the form of a sag of the web loaded by the dancing roller. Upon needle impingement this stock loop is discharged by the discharge roller by lifting the dancing roller. By means of the effective weight of the dancing roller the tensile stress of the web can thus be preselected. For this purpose, the weight of the dancing roller supported on freely rotatable arms, which weight acts on the web, can be adjusted by means of balancing weights. The length of the stored loop determined by the height of the sag is generally adapted to the length withdrawn by the discharge roller during the needle impingement. To achieve a certain degree of stretching for the web, the length of the stored loop may possibly be selected shorter than the length withdrawn by the discharge roller.

Since during the needle impingement merely a comparatively small tensile stress determined by the dead weight and the weight load of the dancing roller is acting on the web, it is due to the resulting substantial freedom from any tensile stress that upon withdrawal of the needles the web may be lifted off the stitch base in a way that impairs the needling result. To restrict the tendency of the web to being lifted off the stitch base, the discharge side of the stitch base may be provided with a deflection surface for the web, which has a larger sliding resistance against the direction of web movement as compared to the sliding resistance in direction of web movement. Since the lift-off of the web from the stitch base during the withdrawal of the needles effects a corresponding redrawing of the web against the direction of web movement on the discharge side, the tendency of the web to being lifted off the stitch base can be restricted by preventing this redrawing movement against the direction of web movement and the withdrawal of the needles from the web can thus be facilitated, which has a direct advantageous effect on the needling result. By correspondingly increasing the sliding resistance against the direction of web movement in the vicinity of a deflection surface such redrawing of the web during the withdrawal of the needles can effectively be prevented. By deflecting the web, the close fit of the web on the deflection surface can be ensured.

The effect of retaining the web with respect to being redrawn against the direction of web movement may be increased additionally when the dancing roller produces a larger conveying resistance for the web against the direction of web movement than in direction of web movement, so that it is also in the vicinity of the dancing roller that a corresponding retaining force can be exerted on the web.

The measures which lead to an increase of the conveying resistance for the web against the direction of web movement should of course not impair the withdrawal of the web in direction of web movement. Since there should also be considered a risk of wear, the deflection surface on the discharge side of the stitch base and/or the dancing roller may be provided with ribs extending transverse to the direction of web movement, which ribs have a serrated cross-section with tooth backs ascending in direction of web movement. The web is sliding over the tooth backs in direction of web movement without having to accept a significant increase of the sliding resistance between the web and the deflection surface and/or the dancing roller. Against the direction of web movement, however, the tips of the teeth have a retarding effect on the web, so that a movement of the web against the direction of web movement is made much more difficult. However, the increase of the sliding friction of the one direction of movement over ribs having a serrated cross-section only represents one possible construction. Another possibility consists in providing a brush-like sliding surface, where the bristles are inclined in direction of web movement.

BRIEF DESCRIPTION OF THE DRAWING

The method in accordance with the invention will now be explained in detail with reference to the drawing, wherein.

DETAILED DESCRIPTION OF PREFERRED EMBODIMENTS

Figure 1:
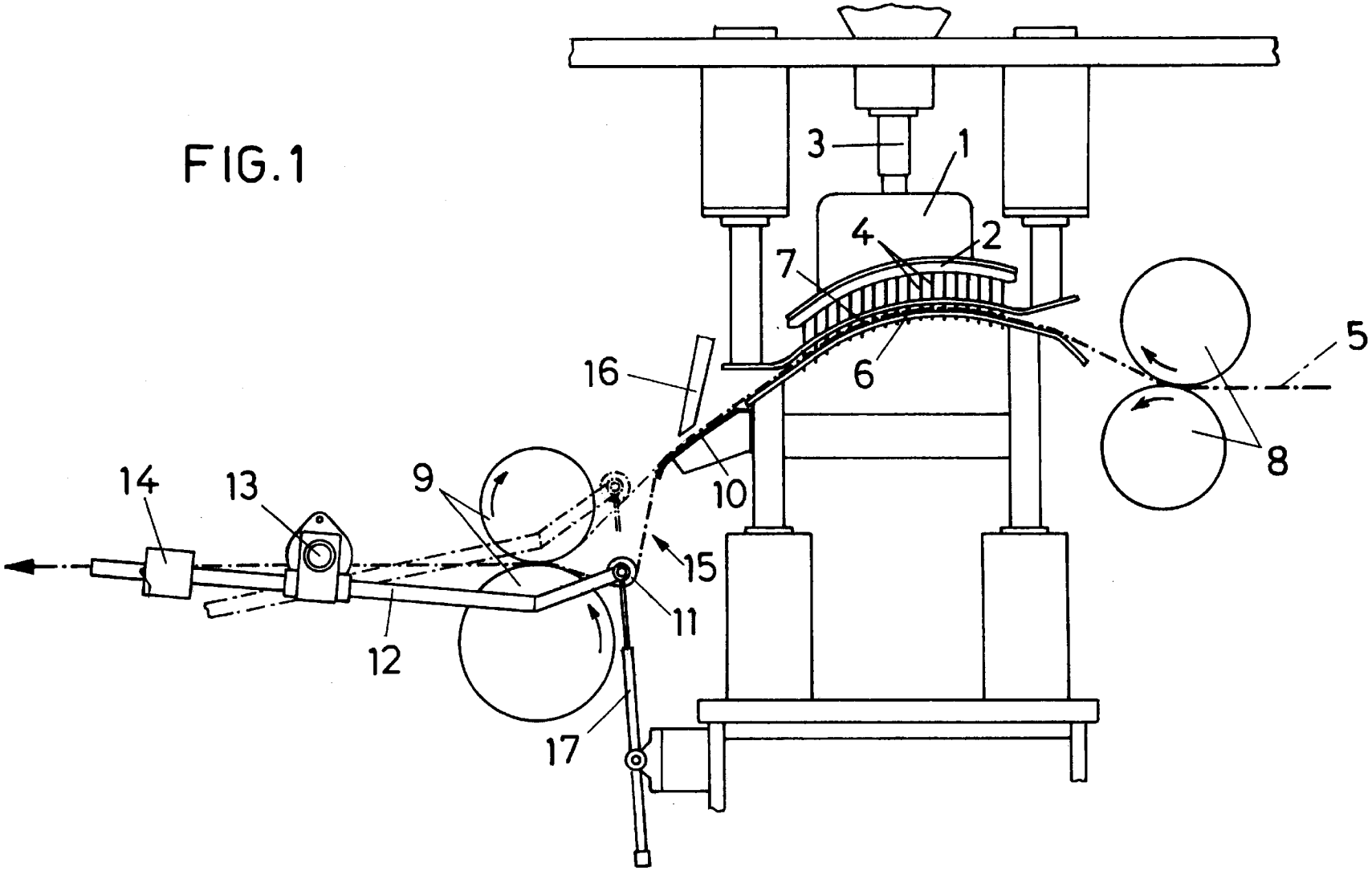
FIG. 1 represents an inventive device for needling a web in a simplified side view.

The device in accordance with the embodiment shown in FIG. 1 comprises a needle board 2 held in a needle bar 1, which needle board is driven by a not represented thrust crank drive whose push rods 3 act on the needle bar 1. The needles 4 of the needle board 2 stitch into the dash-dotted web 5 in the vicinity of a web guide, which consists of a stitch base 6 opposite the needle board 2 and a stripper 7 between the stitch base 6 and the needle board 2 and is disposed between continuously driven feed rollers 8 and discharge roller 9. For adjusting the stitching depth and for adaptation to the respective web thickness both the stitch base 6 and the stripper 7 are vertically adjustable by men of actuators The stitch base 6 and the stripper 7 have a continuous curvature, so that portions with different inclinations in direction of web movement are formed for the web guide. Since the web 5 lies flat against the stitch base 6, there are differently inclined stitch channels for the needles 4 with respect to the web surface in dependence on the respective inclination of the stitch base 6. The average inclination of the stitch base 6 extends at an angle with respect to the direction of movement of the needle board 2, so that there is a corresponding preferred inclination of the needle stitches into the web 5, namely in the sense of stitches with a component in direction of web movement This predominant stitching direction involves an increase in the longitudinal strength of the web 5. Instead of the curved web guide there might of course also be used a conventional, straight web guide.

On the discharge side, the stitch base 6 has been prolonged to form a guiding surface 10 receiving the web 5, between which guiding surface and the discharge roller 9 a dancing roller 11 is provided. This dancing roller 11 is held between freely rotatable arms 12 at each end of the discharge rollers 9, where the rotational axis of said arms is designated with 13. The arms 12 have been prolonged beyond the rotational axis 13, so as to be able to mount balancing weights 14 for adjusting the effective weight of the dancing roller 11.

During the release of the web 5 by the needles 4 the web 5 is conveyed as a result of the weight load effected by the dancing roller 11 through the guiding gap between the stitch base 6 and the stripper 7, so that a sag 15 of the web 5 is formed between the guiding surface 10 and the discharge roller 9, while the dancing roller 11 moves from the dash-dotted swivel position into the swivel position indicated by solid lines. This formation of a stored loop preceding the continuously driven discharge roller 9 is terminated by the impingement of the needles 4, because upon needle impingement the web 5 is retained with respect to the discharge rollers 9, which during the needle impingement is discharging the stored loop by lifting the dancing roller 11, until the web 5 is again released by the needles 4 and a new sag can form, which is fed by the stock loop formed on the supply side during the needle impingement. Since the feed rollers 8 are driven continuously, the web 5 supplied by the feed rollers 8 during the needle impingement is piled up to a corresponding stored loop.

The tensile stress of the web 5 is determined by the weight load effected by the dancing roller 11 and not by the discharge rollers 9, as this is the case with conventional devices for needling a web. This results in the advantageous possibility of needling the web 5 with a predeterminable tensile stress or a predeterminable stretching.

To support the formation of the sag 15 during the release of the web 5 by the needles 4, a blow nozzle 16 may additionally be provided, which is disposed opposite the guiding surface 10 and has a flow component in conveying direction of the web 5. The stream of air of this blow nozzle can effect a larger acceleration of the web 5 and thus larger conveying steps between the needle impingements. As regards the tensile stress of the web 5 the conditions are, however, not changed.

For monitoring the size of the sag 15, the dancing roller 11 may be connected to an inductive position transducer 17, by means of which the withdrawal speed of the discharge rollers 9 may possibly be controlled.

Figure 2:
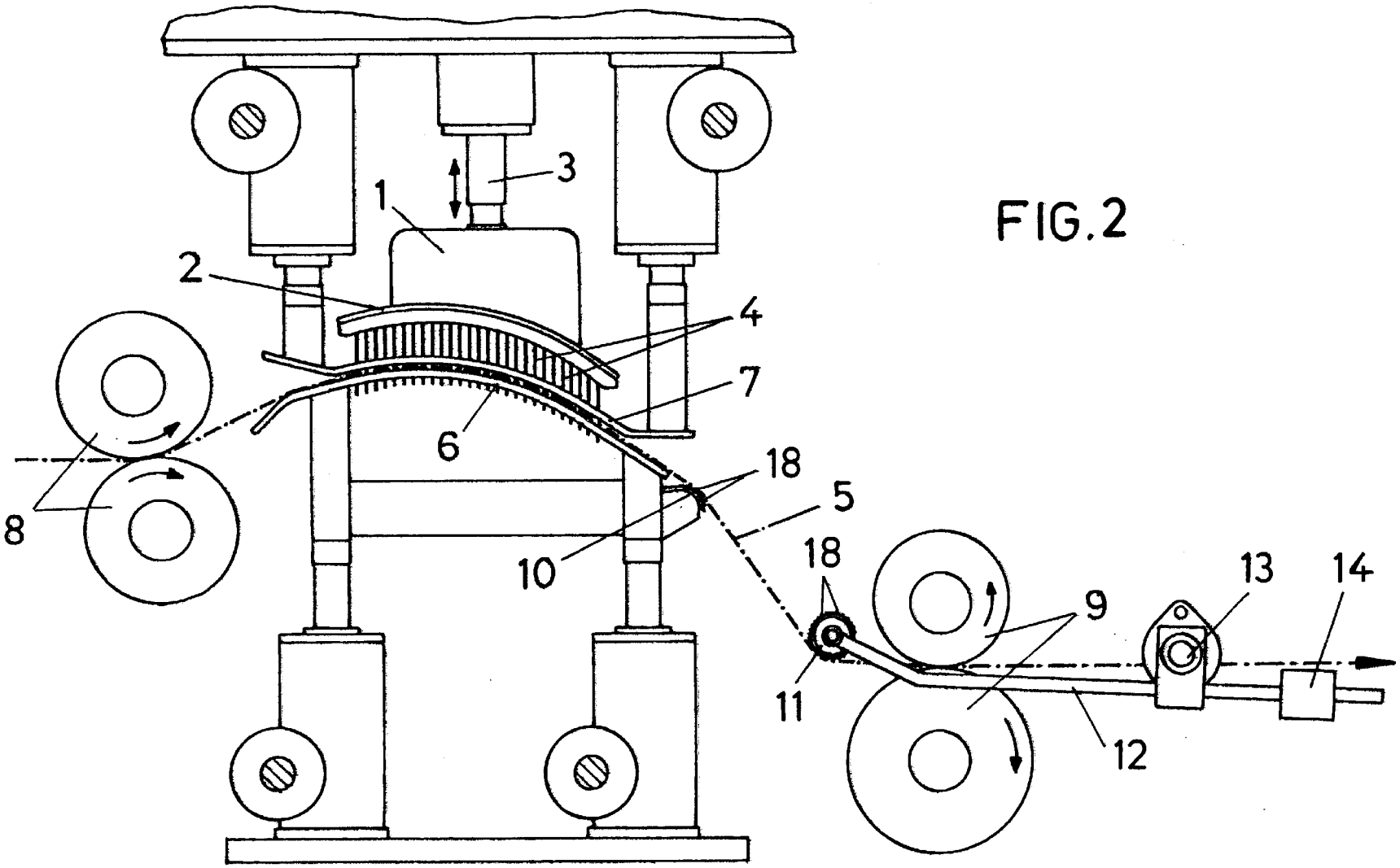
FIG. 2 represents a modified embodiment of an inventive device in a simplified side view.
Figure 3:
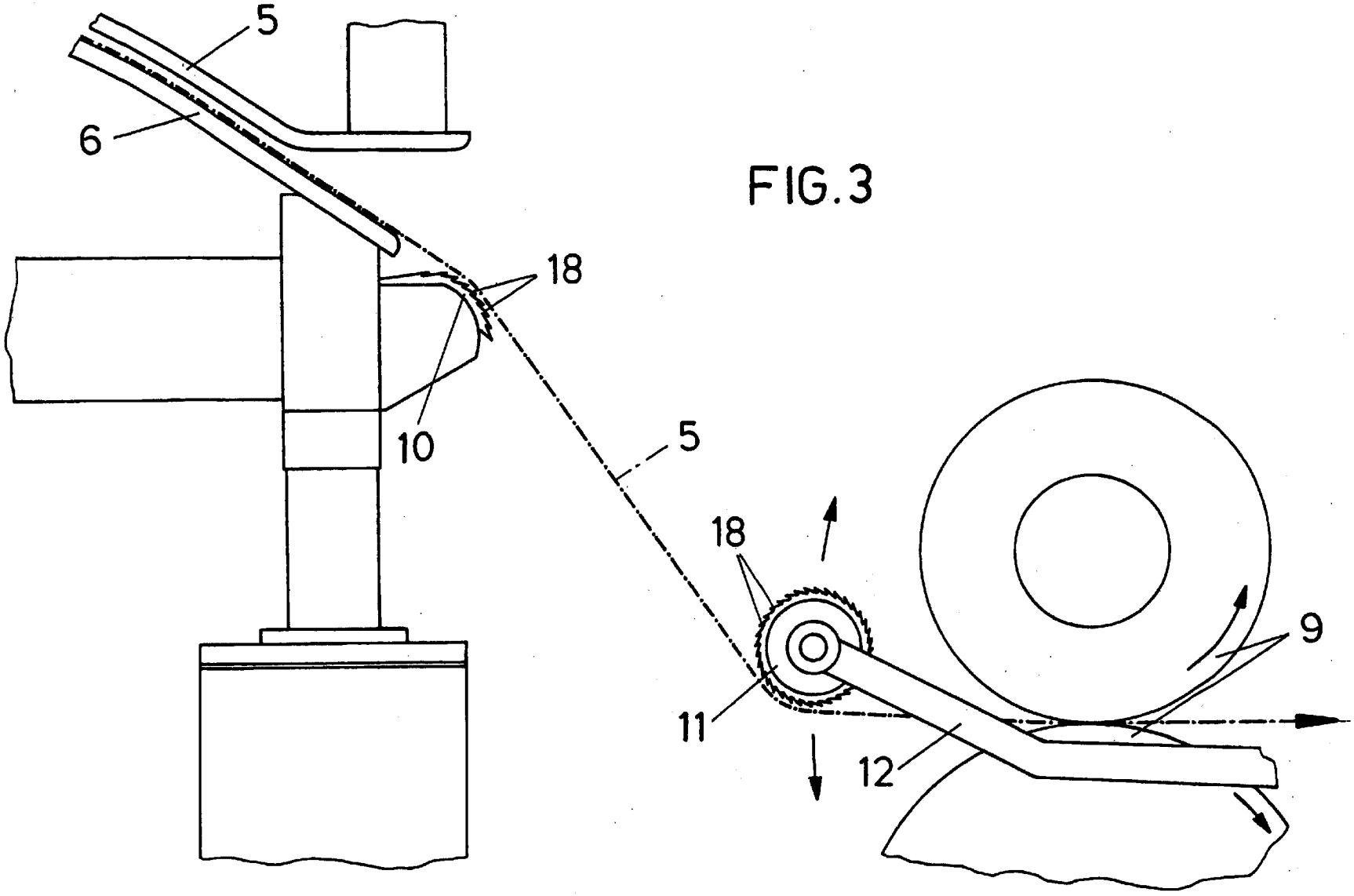
FIG. 3 represents segments of the device shown in FIG. 2 in the vicinity of the dancing roller on an enlarged scale.

In accordance with the embodiment shown in FIGS. 2 and 3 the guiding surface 10 constituting a deflection surface is provided with ribs 18 aligned transverse to the direction of movement of the web 5, which ribs are serrated in cross-section. The arrangement has been made such that the tooth backs are ascending in direction of web movement, as this can be taken in particular from FIG. 3. The dancing roller 11 is likewise provided with transverse ribs 18, which have a serrated cross-section.

The transverse ribs 18 of the deflection surface 10 and/or the dancing roller 11 prevent a movement of the web 5 against the direction of web movement, as this can directly be derived from FIG. 3. In this way, the lift-off of the web 5 from the stitch base 6 during the withdrawal of the needles 4 is easily prevented, because the web 5 can only be lifted off when a sufficient web length is available, which only is the case when the web 5 can be drawn into the gliding gap between the stitch base 6 and the stripper 7 on the discharge side against the direction of web movement. By preventing such opportunity for drawing the web in against the direction of web movement it is thus possible to create advantageous needling conditions, while substantially relieving the web 5 from tensile stresses.

I claim:

1. A method of needling a web, comprising the steps of (a) continuously supplying the web to needles, (b) reciprocating the needles to stitch the web supplied to the needles and to release the stitched web, (c) moving the released stitched web step by step by subjecting the released stitched web to a weight load, and (d) then continuously withdrawing the released stitched web.

2. An apparatus for needling a web, comprising (a) a needle board reciprocable in a stitching direction, (b) a stitch base opposite the needle board, (c) means for continuously supplying the web to the stitch base for stitching the web, (d) means for continuously withdrawing the stitched web, and (e) a dancing roller arranged to exert a weight load on the stitched web between the stitch base and the means for continuously withdrawing the stitched web.

3. The needling apparatus of claim 2, further comprising means for adjusting the weight load, the weight load adjusting means comprising a freely rotatable arm supporting the dancing roller and balancing weight means balancing the weight load of the dancing roller.

4. The needling apparatus of claim 2, wherein the dancing roller has ribs extending transversely to the direction of movement of the web, the ribs having a serrated cross-section with tooth backs ascending in the direction of movement of the web.

5. The needling apparatus of claim 2, further comprising a surface slidably guiding the stitched web between the stitch base and the dancing roller, the guiding surface exerting a sliding resistance on the stitched web opposite the direction of movement of the web.

6. The needling apparatus of claim 5, wherein the guiding surface has ribs extending transversely to the direction of movement of the web, the ribs having a serrated cross-section with tooth backs ascending in the direction of movement of the web.

* * * * *